United States Patent [19]

O'Mara et al.

[11] 4,392,525

[45] Jul. 12, 1983

[54] APPARATUS FOR SECURING A WIRE TO A GRILLE

[75] Inventors: Raymond D. O'Mara, Mallory; Michael E. Smorol, Syracuse; Curtis L. Tobin, Chittenango, all of N.Y.

[73] Assignee: Carrier Corporation, Syracuse, N.Y.

[21] Appl. No.: 202,983

[22] Filed: Nov. 3, 1980

[51] Int. Cl.[3] ..... F28F 13/12; F28F 9/24

[52] U.S. Cl. ..... 165/125; 62/507

[58] Field of Search ..... 165/76, 125, 122; 62/507, 508, 262, 298

[56] References Cited

U.S. PATENT DOCUMENTS 4,036,292 7/1977 Hine, Jr. ..... 165/122

4,202,409 5/1980 Cann et al. ..... 165/125 X

*Primary Examiner*—Sheldon J. Richter

*Attorney, Agent, or Firm*—Donald F. Daley; Robert P. Hayter

[57] ABSTRACT

A heat exchange unit for use with an air conditioning system having an enclosure defining an opening, a heat exchanger within the enclosure and a grille adapted mounted to the enclosure at the opening, the grille having segments extending between a solid center portion of the grille and an edge portion such that slots are created between adjacent segments. A fan motor is suspended from the center of the grille and a special louver segment is created extending from the fan motor to the edge portion. This louver segment includes inclined segments which coact with a wire guide for forming a wire securing cavity extending from the fan motor to the control section of the unit. This combination louver configuration and wire guide acts to secure the wire in a preselected position.

5 Claims, 5 Drawing Figures

APPARATUS FOR SECURING A WIRE TO A GRILLE

BACKGROUND OF THE INVENTION

1. Field of the Invention

This invention relates to heat exchange units for use in an air conditioning system. Particularly, this invention relates to a grille and wire guide assembly for use with the outdoor heat exchange unit of a heat pump or a condenser unit of the cooling system wherein the fan motor is suspended from the center of the grille.

2. Description of the Prior Art

Air conditioning systems for conditioning residences and other interior spaces frequently utilize a combination of components such that the condensing unit of an air conditioning system is located outside of the residence and the evaporator unit of the system is located in communication with the interior space to be cooled. In a heat pump application the system might have an outdoor heat exchange unit located without the enclosure and an interior heat exchange unit in communication with the interior space to be conditioned. The systems further utilize a compressor and appropriate expansion valves and piping such that heat energy may be transferred either to the region to be heated or from the region to be cooled. Each outdoor unit has an electric motor and fan associated therewith such that outdoor air may be drawn through the heat exchanger of the unit. This air typically flows through a grille either upon entering the unit or being discharged from the unit.

The proper mounting and operation of the unit is very important because the operation of the air conditioning system depends upon the capability of the heat exchanger located in the outdoor unit to transfer heat to or from the air. Furthermore, the outdoor location of the fan and motor renders it susceptible to various sorts of damage. For example, the operation of the fan motor can be seriously impaired if moisture or dirt enter the motor bearings. The likelihood of such damage is greater in those units wherein the fan shaft extends vertically upwardly since water can run down the shaft and through the bearings. This type of problem may be avoided by suspending the fan motor from a grille such that the solid center portion of the grille covers the fan motor and prevents moisture from entering same. By suspending the fan motor from the middle of a grille it is apparent that air is being discharged completely around that portion where the motor is mounted and it is necessary to find some means to secure an electrical conductor between the fan motor and the remainder of the unit.

The present invention relates to a heat exchange unit having a grille with a solid center portion wherein the fan motor is suspended and radially extending louver segments between the solid center portion and the edge thereof. One of these radially extending segments has a flat top surface and two inclined segments such that a generally U-shaped channel is formed extending from the center portion to the edge thereof. A wire guide extending from the edge of the grille to the center portion covers the opening created at the bottom of the louver segment and has wire guide lips extending from the edges thereof to secure the wire guide to the louver segment. Once secured, a wire carrying cavity for securing the wire extending from the fan motor to the exterior edge of the grille and/or through the fan orifice is provided.

SUMMARY OF THE INVENTION

An object of the present invention is to provide a grille for an outdoor heat exchange unit.

A further object of the present invention is to mount an electric motor and fan to a grille such that air flow through the unit is discharged through the grille.

Another object of the present invention is to have a two-component assembly wherein electrical wire connecting a fan motor mounted in the middle of the grille may be secured such that it is protected from the weather, out of the air flow stream and impervious to being damaged by foreign objects entering the unit.

A still further object of the present invention is to provide an assembly having two components which may be easily constructed to form a cavity for securing an electrical conductor.

Another object of the present invention is to provide an easy to manufacture, assemble and relatively inexpensive but durable apparatus for securing an electrical conductor to a portion of a top discharge grille of an air conditioning unit.

Other objects will be apparent from the description to follow and from the appended claims.

The foregoing objects are achieved according to a preferred embodiment of the invention by providing an outdoor heat exchange unit having a heat exchanger within an enclosure, a fan orifice located in the unit and a fan for drawing heat transfer medium, typically air, through the heat exchanger and discharging same out of the unit. The fan orifice coacts with the fan for directing air flow through the unit. A grille is mounted to cover the discharge opening of the fan orifice and has the fan motor to which the fan blades are attached mounted from the center thereof. Radially extending louver segments connect the center portion of the grille with the edge portion. A wire cover louver segment having a flat top surface and two side inclined segments forms a portion of the cavity for securing the fan motor wire. A wire guide having a flat bottom surface and wire guide lips for securing the wire guide to the louver segment of the grille is provided to complete the wire securing cavity. Additionally, the wire guide has an inclined portion, two side portions and a fastening portion which provide for an expanded cavity such that wire being connected to the motor has an area which it may enter the defined cavity.

DESCRIPTION OF THE PREFERRED EMBODIMENT

The embodiment of the invention described below is shown in a particular outdoor heat exchange unit. This unit is arranged with a top discharge grille with a fan motor mounted in the center thereof. This invention will find like applicability in any grille wherein an electrical connector traverses an air flow stream or heat transfer medium flow stream and must be secured within that flow stream. Although shown as a top discharge grille, this invention has like applicability in other mounting configurations and in configurations where the fan is not centered in the grille.

Figure 1:
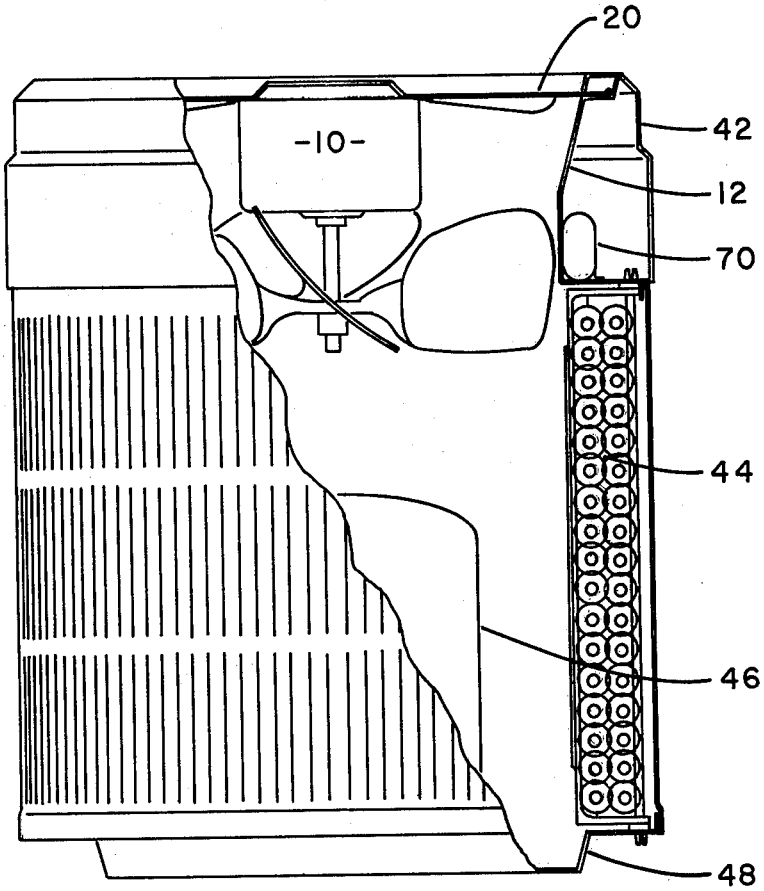
FIG. 1 is a sectional view of an outdoor heat exchange unit.

Referring now to the drawings it can be seen in FIG. 1 that a generally cylindrical unit is provided having a base pan 48 compressor 46 and heat exchanger 44 are supported. On the top of heat exchanger 44 is a fan orifice 12 and top cover 42. Grille 20 sets on the top of fan orifice 12 and defines an air discharge opening such that heat transfer medium, typically outdoor air, may be conducted therethrough. Air is drawn into the unit through the circumferentially extending heat exchanger 44 and discharged upwardly from the top of the unit through grille 20. Fan orifice 12 acts to support grille 20 and top cover 42. Electrical components 70 are shown mounted within the cavity formed between top cover 42 and grille 20. It is necessary to connect these electrical components to fan motor 10 such that it may be appropriately energized.

Figure 2:
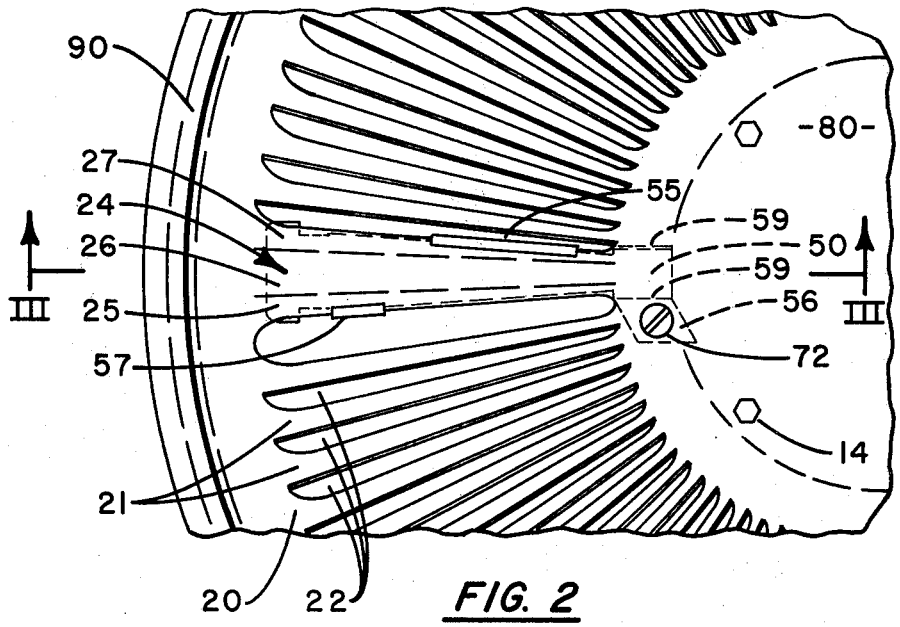
FIG. 2 is a cut away top view portion of the grille and wire guide of the unit.

Referring now to FIG. 2 there may be seen a top view of a portion of grille 20. The grille has a solid center portion 80 and an edge portion 90 which are connected by numerous radially extending louver segments. Louver segments consist of flat louver segments 21 and inclined louver segments 22. Air flow passes between the flat segments through the openings created when the inclined louver segments are displaced therefrom. In the center of the drawing can be seen wire cover louver 24 having a top flat portion 26 and two inclined louver segments extending from each edge of the top portion referenced by numerals 25 and 27.

It can also be seen in FIG. 2 that the wire guide 50 has a wire guide bottom portion 51, wire guide lips 57 amd 55, wire guide inclined portion 58, two wire guide side portions 59 and wire guide fastening portion 56. Screw 72 is shown extending through the grille into wire guide fastening portion 56.

Figure 3:
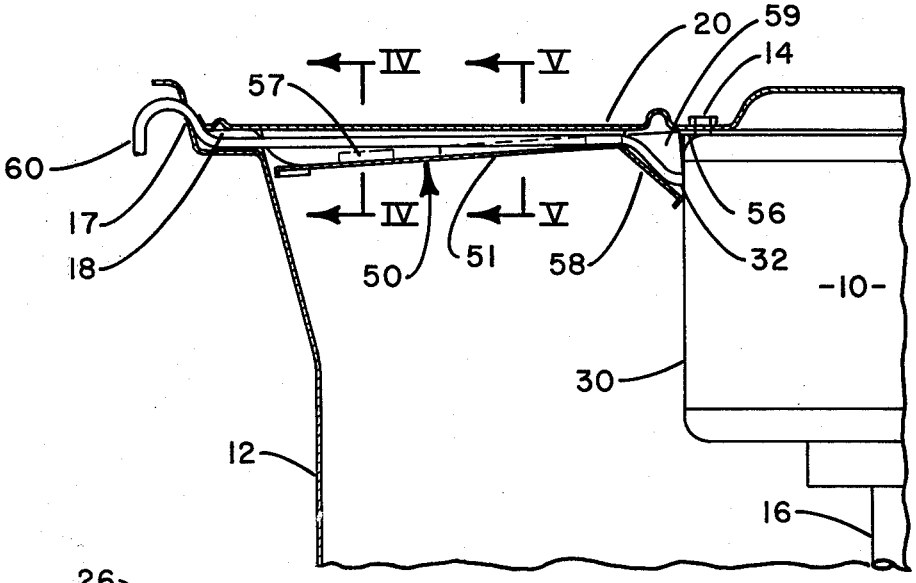
FIG. 3 is a partial sectional view showing the fan orifice, fan motor and the interaction of the grille with the wire guide.

In FIG. 3, a sectional view of FIG. 2, it can be seen that grille 20 extends from a solid center portion from which fan motor 10 is mounted via fan bolt 14 to the edge of the grille portion which rests on fan orifice 12. It can also be seen that the depth of the inclined louver section increases as the radial distance outwardly from the fan motor increases. Wire guide lips 57 and 55 can also be seen as can the relationship between the wire guide inclined portion 58, wire guide side portions 59 and the wire guide fastening portion 56. Wire outlet 32 from the fan motor is shown to indicate the place of origin or wire 60 extending from the fan motor to the electrical controls area behind fan orifice 12. Fan orifice wire opening 17 is shown where the wire 60 penetrates orifice 12.

Figure 4:
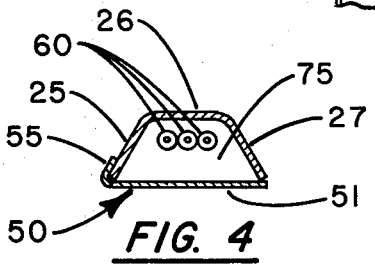
FIG. 4 is a sectional view of the grille and wire guide taken at line IV—IV of FIG. 3.
Figure 5:
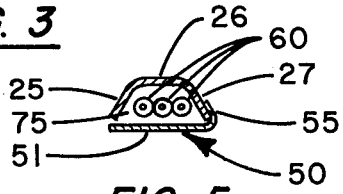
FIG. 5 is a sectional view of the grille and wire guide taken along line V—V of FIG. 3.

FIGS. 4 and 5 show two sectional views taken from FIG. 3 indicating the relationship between the louver and the wire guide. In FIG. 4 it can be seen that the top portion of wire cover louver 26 has downward extending segments 25 and 27 attached to the edge thereof. Wire guide 50 is shown having wire guide bottom portion 51 and wire guide lip 57 extending upwardly from bottom portion 51 engaging inclined segment 25. Wire 60 is shown located within the wire securing cavity 75.

FIG. 5 is substantially similar to FIG. 4 except that wire guide lip 55 engages inclined segment 27 on the opposite side of the wire cover louver from where wire guide lip 55 engages inclined segment 25.

It can be seen from the above arrangement of components that a wire securing cavity is created extending the length of the distance between fan motor 10 and the controls area behind fan orifice 12. The wire guide and louver are sized such that this cavity enables the fan motor wire to be secured therein. At one end of the cavity an expansion area is created utilizing wire guide inclined portion 58 and two wire guide side portions 59 such that the wire originating from wire outlet 32 of fan motor 10 may enter therethrough. The utilization of this type combination grille and wire guide serves to isolate the wire from air currents and water entering the unit, serves to prevent the wire from contact with miscellaneous debris cycled by the fan and serves to prevent contact by any foreign objects being inserted through the grille.

The invention has been described in detail with particular reference to a preferred embodiment thereof, but it will be understood that variations and modifications can be effected within the spirit and scope of the invention.

What is claimed is:

1. A heat exchange unit including a heat exchanger which comprises:

a fan orifice, a fan powered by an electric motor for coacting with the fan orifice for circulating a heat transfer medium through the heat exchanger of the heat exchange unit, a grille covering the fan orifice to allow heat transfer medium to flow therethrough while preventing foreign objects from being inserted therein, said grille including a portion extending from the fan motor to the fan orifice, an electrical power source entering the heat exchange unit a distance from the electric motor, at least one electricity carrying conductor connecting the electric motor to the power source, and a wire guide extending between the fan orifice and the electric motor, said wire guide coacting with the portion of the grille extending from the fan motor to the fan orifice to define a cavity wherein the conductor connected to the electric motor is secured.

2. The apparatus as set forth in claim 1 wherein the grille further includes a radially extending louver having a relatively flat portion and two louver inclined segments each extending from one edge of the flat portion and wherein the wire guide coacts with the two inclined louver segments and the flat louver portion to define a cavity for the conductor.

3. The apparatus as set forth in claim 2 wherein the wire guide further comprises:

a wire guide bottom portion, a first wire guide lip extending from the wire guide bottom portion at an angle thereto to engage a louver inclined segment, and a second wire guide lip extending from the wire guide bottom portion at an angle thereto to engage the other louver inclined segment.

4. The apparatus as set forth in claim 3 wherein the wire guide further comprises a wire guide inclined portion extending downwardly from the wire guide bottom portion, two wire guide side portions extending upwardly one from each edge of the inclined portion and a wire guide fastening portion extending from one side portion, the inclined portion and two side portions forming a conductor receiving entryway for receiving the conductor where it is connected to the motor.

5. The apparatus as set forth in claim 4 wherein the wire guide fastening portion is secured to the grille by fastening means.

* * * * *